US010350913B2

(12) United States Patent
Tokuchi

(10) Patent No.: US 10,350,913 B2
(45) Date of Patent: Jul. 16, 2019

(54) IMAGE FORMING APPARATUS AND NON-TRANSITORY COMPUTER READABLE MEDIUM FOR PROCESSING AN INSTRUCTION TO USE A BORDERLESS PRINTING FUNCTION

(71) Applicant: FUJI XEROX CO., LTD., Tokyo (JP)

(72) Inventor: Kengo Tokuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 7 days.

(21) Appl. No.: 15/599,708

(22) Filed: May 19, 2017

(65) Prior Publication Data

US 2018/0111393 A1 Apr. 26, 2018

(30) Foreign Application Priority Data

Oct. 21, 2016 (JP) ..... 2016-206506
Dec. 27, 2016 (JP) ..... 2016-252659

(51) Int. Cl.
*G03G 15/20* (2006.01)
*B41J 11/00* (2006.01)
*G03G 21/00* (2006.01)

(52) U.S. Cl.
CPC ..... *B41J 11/0065* (2013.01); *G03G 15/2025* (2013.01); *G03G 21/00* (2013.01); *G03G 2215/00734* (2013.01); *G03G 2221/1639* (2013.01)

(58) Field of Classification Search
CPC ..... G03G 15/2025; G03G 21/00; G03G 2221/1639; G03G 2215/00734; B41J 11/0065
See application file for complete search history.

(56) References Cited

U.S. PATENT DOCUMENTS 5,749,037 A * 5/1998 Takayuki ..... G03G 15/2025 399/327
8,699,084 B2 * 4/2014 Sugimoto ..... H04N 1/00 358/1.9
8,918,039 B2 * 12/2014 Arikawa ..... G03G 15/2025 399/327
9,134,673 B2 * 9/2015 Iida ..... G03G 15/5095
2005/0057593 A1 * 3/2005 Kachi ..... B41J 11/003 347/14
2006/0024096 A1 * 2/2006 Kimura ..... G03G 15/2025 399/325

(Continued)

FOREIGN PATENT DOCUMENTS

JP 2005-257779 A 9/2005
JP 2007-50572 A 3/2007

(Continued)

OTHER PUBLICATIONS

Communication dated Sep. 19, 2017 issued by the Japanese Patent Office in counterpart application No. JP 2016-252659.

(Continued)

*Primary Examiner* — David J Bolduc
(74) *Attorney, Agent, or Firm* — Sughrue Mion, PLLC

(57) ABSTRACT

An image forming apparatus is provided. Upon receiving a borderless printing instruction, the image forming apparatus performs cleaning processing according to a sheet size. The cleaning processing is different from cleaning processing to be performed when a border printing instruction is received.

4 Claims, 12 Drawing Sheets

(56) References Cited

U.S. PATENT DOCUMENTS

| | | | | |
|---|---|---|---|---|
| 2006/0197983 | A1* | 9/2006 | Hatanaka | B41J 2/2107 358/1.18 |
| 2007/0008397 | A1* | 1/2007 | Maebashi | G03G 15/1605 347/158 |
| 2010/0310288 | A1* | 12/2010 | Takagi | G03G 15/2025 399/327 |
| 2011/0211220 | A1* | 9/2011 | Yamada | G03G 15/5016 358/1.15 |
| 2012/0269531 | A1* | 10/2012 | Suzuki | G03G 15/657 399/67 |
| 2014/0119763 | A1 | 5/2014 | Yamaura et al. | |
| 2015/0262049 | A1* | 9/2015 | Kawano | B41J 11/0065 412/16 |
| 2016/0274499 | A1* | 9/2016 | Funayama | G03G 15/0131 |

FOREIGN PATENT DOCUMENTS

| | | | |
|---|---|---|---|
| JP | 2008-89657 | A | 4/2008 |
| JP | 2008-122512 | A | 5/2008 |
| JP | 2008152307 | A | 7/2008 |
| JP | 2010-164775 | A | 7/2010 |
| JP | 2011-180697 | A | 9/2011 |
| JP | 2012-133203 | A | 7/2012 |
| JP | 2014-85576 | A | 5/2014 |
| JP | 2014081607 | A | 5/2014 |
| JP | 5958274 | B2 | 7/2016 |
| JP | 2016173546 | A | 9/2016 |

OTHER PUBLICATIONS

Communication dated Jun. 19, 2018 from the Japanese Patent Office in counterpart Japanese application No. 2017-198464.

* cited by examiner

FIG. 9

900

| 910 | 920 | 930 | 940 | 950 |
|---|---|---|---|---|
| DATE | NUMBER OF SHEETS | SHEET SIZE | MONOCHROME/ COLOR | USER |
| | | | | |

FIG. 10

1000

| 1010 | 1020 |
|---|---|
| USER | PERMISSIBLE NUMBER OF SHEETS |
| | |

IMAGE FORMING APPARATUS AND NON-TRANSITORY COMPUTER READABLE MEDIUM FOR PROCESSING AN INSTRUCTION TO USE A BORDERLESS PRINTING FUNCTION

CROSS-REFERENCE TO RELATED APPLICATIONS

This application is based on and claims priority under 35 USC 119 from Japanese Patent Application Nos. 2016-206506 filed Oct. 21, 2016 and 2016-252659 filed Dec. 27, 2016.

BACKGROUND

Technical Field

The present invention relates to an image forming apparatus and a non-transitory computer readable medium.

SUMMARY

According to an aspect of the invention, there is provided an image forming apparatus. Upon receiving a borderless printing instruction, the image forming apparatus performs cleaning processing according to a sheet size. The cleaning processing is different from cleaning processing to be performed when a border printing instruction is received.

BRIEF DESCRIPTION OF THE DRAWINGS

An exemplary embodiment of the present invention will be described in detail based on the following figures, wherein:

FIG. 9 illustrates an example of the data structure of a borderless-printing log table;

FIG. 10 illustrates an example of the data structure of a user permissible-number-of-sheets table;

DETAILED DESCRIPTION

An exemplary embodiment of the invention will be described below with reference to the accompanying drawings.

Figure 1:
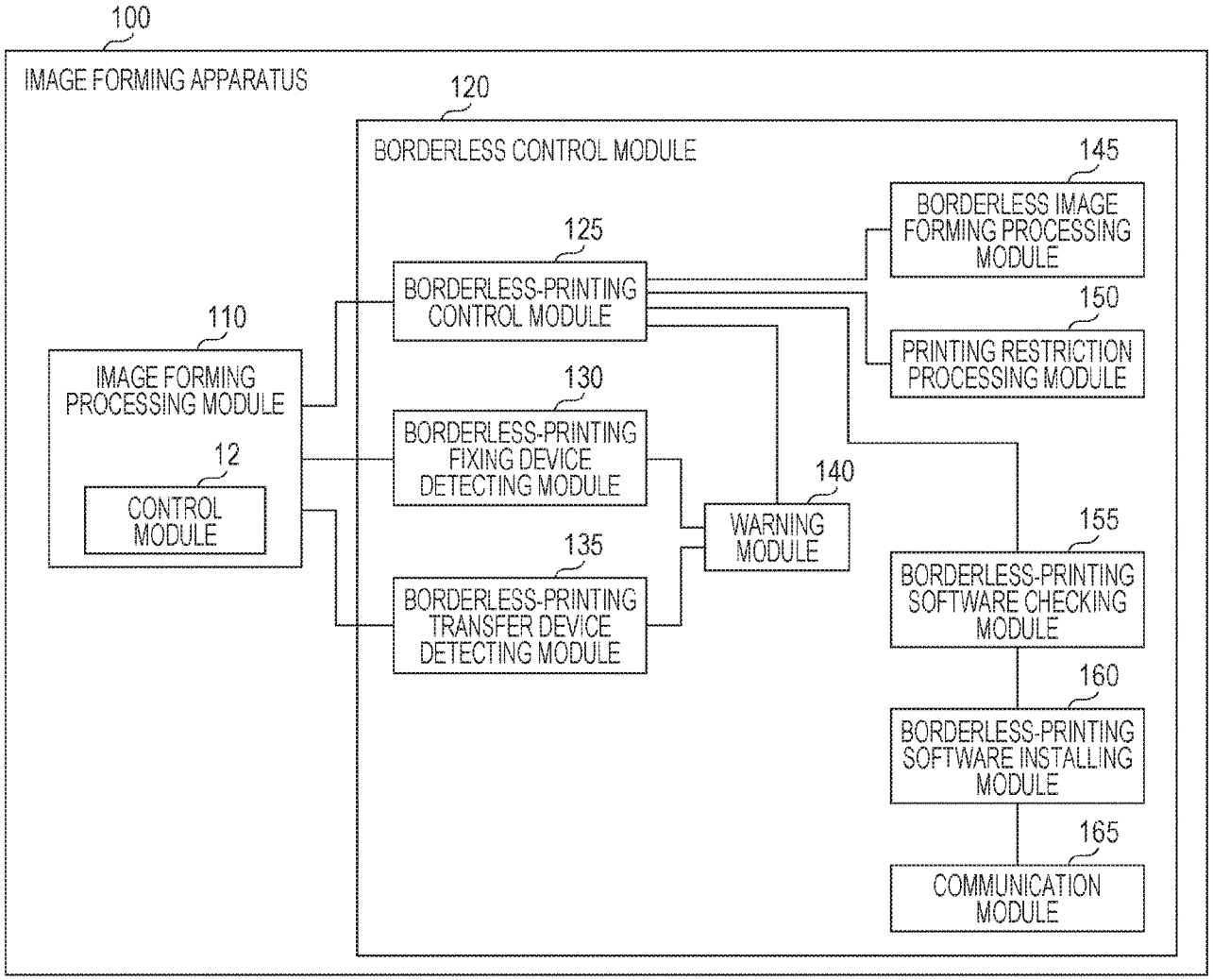
FIG. 1 is a block diagram of conceptual modules forming an example of the configuration of the exemplary embodiment.

FIG. 1 is a block diagram of conceptual modules forming an example of the configuration of the exemplary embodiment.

Generally, modules are software (computer programs) components or hardware components that can be logically separated from one another. The modules of the exemplary embodiment of the invention are, not only modules of a computer program, but also modules of a hardware configuration. Thus, the exemplary embodiment will also be described in the form of a computer program for allowing a computer to function as those modules (a program for causing a computer to execute program steps, a program for allowing a computer to function as corresponding units, or a computer program for allowing a computer to implement corresponding functions), a system, and a method. While expressions such as "store", "storing", "being stored", and equivalents thereof are used for the sake of description, such expressions indicate, when the exemplary embodiment relates to a computer program, storing the computer program in a storage device or performing control so that the computer program will be stored in a storage device. Modules may correspond to functions based on a one-to-one relationship. In terms of implementation, however, one module may be constituted by one program, or plural modules may be constituted by one program. Conversely, one module may be constituted by plural programs. Additionally, plural modules may be executed by using a single computer, or one module may be executed by using plural computers in a distributed or parallel environment. One module may integrate another module therein. Hereinafter, the term "connection" includes not only physical connection, but also logical connection (sending and receiving of data, giving instructions, reference relationships among data elements, etc.). The term "predetermined" means being determined prior to a certain operation, and includes the meaning of being determined prior to a certain operation before starting processing of the exemplary embodiment, and also includes the meaning of being determined prior to a certain operation even after starting processing of the exemplary embodiment, in accordance with the current situation/state or in accordance with the previous situation/state. If there are plural "predetermined values", they may be different values, or two or more of the values (or all the values) may be the same. A description having the meaning "in the case of A, B is performed" is used as the meaning "it is determined whether the case A is satisfied, and B is performed if it is determined that the case A is satisfied", unless such a determination is unnecessary.

A system or an apparatus may be implemented by connecting plural computers, hardware units, devices, etc., to one another via a communication medium, such as a network (including communication based on a one-to-one correspondence), or may be implemented by a single computer, hardware unit, device, etc. The terms "apparatus" and "system" are used synonymously. The term "system" does not include merely a man-made social "mechanism" (social system).

Additionally, every time an operation is performed by using a corresponding module or every time each of plural operations is performed by using a corresponding module, target information is read from a storage device, and after performing the operation, a processing result is written into the storage device. A description of reading from the storage device before an operation or writing into the storage device after an operation may be omitted. Examples of the storage device may be a hard disk (HD), a random access memory (RAM), an external storage medium, a storage device using a communication line, a register within a central processing unit (CPU), etc.

An image forming apparatus 100 according to this exemplary embodiment has a printing function, and is typically a printer, a copying machine, or a multifunction device (an image forming apparatus including at least one of functions as a printer and a copying machine and including plural functions as a scanner, a fax machine, etc.)

As shown in FIG. 1, the image forming apparatus 100 includes an image forming processing module 110 and a borderless control module 120. The image forming apparatus 100 is able to set or attach a fixing device for borderless printing (hereinafter may also be called "a borderless-printing fixing device") or a transfer device for borderless printing (hereinafter may also be called "a borderless-printing transfer device"). Only a borderless-printing fixing device or only a borderless-printing transfer device may be set or attached. Alternatively, both of a borderless-printing fixing device and a borderless-printing transfer device may be set or attached. Setting or attaching a borderless-printing fixing device means replacing a fixing device which is not for borderless printing, that is, a regular fixing device, by a borderless-printing fixing device, and vice versa. Setting or attaching a borderless-printing transfer device means replacing a transfer device which is not for borderless printing, that is, a regular transfer device, by a borderless-printing transfer device, and vice versa.

The image forming apparatus 100 is capable of performing borderless printing. The image forming apparatus 100 provided with a borderless-printing fixing device and a borderless-printing transfer device is able to perform borderless printing with high image quality. The image forming apparatus 100 provided with only one of a borderless-printing fixing device and a borderless-printing transfer device or with neither of them is still able to perform borderless printing. However, this may decrease the image quality or cause a failure in the image forming apparatus 100. It is hard to know from the outside whether a borderless-printing fixing device or a borderless-printing transfer device is set in the image forming apparatus 100. An example of the difference between a borderless-printing fixing device or a borderless-printing transfer device and a regular fixing device or a regular transfer device is a cleaning mechanism.

In response to an instruction to use a borderless printing function from a user, the image forming apparatus 100 determines whether the fixing device or the transfer device set in the image forming apparatus 100 is that for borderless printing. If the fixing device or the transfer device is not for borderless printing, the image forming apparatus 100 issues a warning. The image forming apparatus 100 is still able to perform borderless printing if the user ignores this warning.

The image forming processing module 110 includes a control module 12, and is connected to a borderless-printing control module 125, a borderless-printing fixing device detecting module 130, and a borderless-printing transfer device detecting module 135 of the borderless control module 120. The image forming processing module 110 executes image forming processing in the image forming apparatus 100. More specifically, the image forming processing module 110 executes printing processing in response to a print instruction provided by a user operation or from a user terminal 220, for example. If the print instruction includes an instruction to perform borderless printing, the image forming processing module 110 causes the borderless control module 120 to execute processing. The control module 12 controls the image forming processing module 110 so that the image forming processing module 110 will execute image forming processing.

Details of the processing executed by the image forming processing module 110 and the control module 12 (in particular, borderless printing processing) will be discussed later with reference to examples shown in FIGS. 3 to 5C.

The borderless control module 120 includes the borderless-printing control module 125, the borderless-printing fixing device detecting module 130, the borderless-printing transfer device detecting module 135, a warning module 140, a borderless image forming processing module 145, a printing restriction processing module 150, a borderless-printing software checking module 155, a borderless-printing software installing module 160, and a communication module 165. The borderless control module 120 executes processing when a print instruction includes an instruction to perform borderless printing.

The borderless-printing control module 125 is connected to the image forming processing module 110, the warning module 140, the borderless image forming processing module 145, the printing restriction processing module 150, and the borderless-printing software checking module 155. The borderless-printing control module 125 controls the modules within the borderless control module 120 in response to an instruction from the image forming processing module 110.

The borderless-printing fixing device detecting module 130 is connected to the image forming processing module 110 and the warning module 140. The borderless-printing fixing device detecting module 130 detects whether a borderless-printing fixing device is set in the image forming processing module 110. The borderless-printing fixing device detecting module 130 may detect a cleaner unit attached to a fixing device as a borderless-printing fixing device.

The borderless-printing transfer device detecting module 135 is connected to the image forming processing module 110 and the warning module 140. The borderless-printing transfer device detecting module 135 detects whether a borderless-printing transfer device is set in the image forming processing module 110. The borderless-printing transfer device detecting module 135 may detect a cleaner unit attached to a transfer device as a borderless-printing transfer device.

The borderless-printing fixing device detecting module 130 and the borderless-printing transfer device detecting module 135 may make the above-described determination as to whether information (flag or attribute information) indicating that a borderless-printing fixing device or a borderless-printing transfer device is set in the image forming processing module 110 is stored in a predetermined storage region. This storage region may be within a storage unit included in the fixing device or in the transfer device, or within a storage unit in the image forming apparatus 100. The borderless-printing fixing device detecting module 130 and the borderless-printing transfer device detecting module 135 may make the above-described determination by using a sensor, such as an optical sensor, a magnetic sensor, or a mechanical switch. If a borderless-printing fixing device or a borderless-printing transfer device is set, the sensor is ON (or OFF), and the borderless-printing fixing device detecting module 130 and the borderless-printing transfer device detecting module 135 make the above-described determination based on the state of the sensor. In particular, if the above-described storage region is not provided, the sensor may suitably be used.

The warning module 140 is connected to the borderless-printing control module 125, the borderless-printing fixing device detecting module 130, and the borderless-printing transfer device detecting module 135. When using a borderless printing function, if the fixing device or the transfer device is not for borderless printing, the warning module 140 issues a warning. "Using a borderless printing function" corresponds to a case, for example, in which the image forming processing module 110 receives a print instruction provided by a user operation or from a user terminal 220 including an instruction to perform borderless printing. "When the fixing device is not for borderless printing" corresponds to a detection result of the borderless-printing fixing device detecting module 130 in which a borderless-printing fixing device is not set. "When the transfer device is not for borderless printing" corresponds to a detection result of the borderless-printing transfer device detecting module 135 in which a borderless-printing transfer device is not set. "When the fixing device or the transfer device is not for borderless printing" includes "the fixing device is not for borderless printing", "the transfer device is not for borderless printing", and "neither of the fixing device nor the transfer device is for borderless printing". If the image forming apparatus 100 is capable of performing high-quality borderless printing only by using a borderless-printing fixing device (and a regular-printing transfer device), "when the fixing device or the transfer device is not for borderless printing" may include only "the fixing device is not for borderless printing". If the image forming apparatus 100 is capable of performing high-quality borderless printing only by using a borderless-printing transfer device (and a regular-printing fixing device), "when the fixing device or the transfer device is not for borderless printing" may include only "the transfer device is not for borderless printing". If the image forming apparatus 100 is able to set or attach only a borderless-printing fixing device (unable to set or attach a borderless-printing transfer device), "when the fixing device or the transfer device is not for borderless printing" may include only "the fixing device is not for borderless printing". If the image forming apparatus 100 is able to set or attach only a borderless-printing transfer device (unable to set or attach a borderless-printing fixing device), "when the fixing device or the transfer device is not for borderless printing" may include only "the transfer device is not for borderless printing".

Issuing a warning may include, not only, displaying of the content of a warning on a display, such as a liquid crystal display, but also outputting of the content of a warning as three-dimensional (3D) video, or outputting of warning sound (including warning voice) or vibration to a sound output unit such as a speaker, or a combination thereof.

The borderless image forming processing module 145 is connected to the borderless-printing control module 125. If a borderless-printing fixing device or a borderless-printing transfer device is not set in the image forming apparatus 100, upon receiving an instruction to use the borderless printing function, the borderless image forming processing module 145 executes different image forming processing from that when a borderless-printing fixing device and a borderless-printing transfer device are set. The borderless image forming processing module 145 may make a determination as to whether a borderless-printing fixing device or a borderless-printing transfer device is set, based on detection results of the borderless-printing fixing device detecting module 130 and the borderless-printing transfer device detecting module 135. "Upon receiving an instruction to use the borderless printing function" corresponds to a case, for example, in which the image forming processing module 110 receives a print instruction provided by a user operation or from a user terminal 220 including a borderless print instruction.

As "the different image forming processing", the borderless image forming processing module 145 may reduce the density of an image in a peripheral portion, which is a border, of a sheet. The peripheral portion is the four sides of a sheet (a portion having a predetermined width from the border), and is not used in regular printing (border printing). Reducing the density of an image printed in this peripheral portion can decrease the amount of toner required for cleaning. The density is reduced to 80%, for example, of the density of the original image. Instead of uniformly reducing the density in the peripheral portion, the degree by which the density is reduced may be increased toward the border. Instead of reducing the density for all the four sides of a sheet, the density of the four sides may selectively be reduced, such as the density only in the forward side of a sheet or only in the two lateral sides of a sheet in the transport direction may be reduced. If the density of an image on the four sides is equal to or less than a predetermined density, the density may not be reduced.

As "the different image forming processing", the borderless image forming processing module 145 may increase the frequency with which cleaning for the transfer device or the fixing device is performed from that when a borderless-printing fixing device and a borderless-printing transfer device are set. For example, the cleaning frequency for each of the fixing device and the transfer device may be increased. Alternatively, to increase the cleaning frequency, image formation is not performed after borderless printing, but only a blank sheet is fed so that remaining toner in the transfer device or the fixing device can be sucked onto this blank sheet. If the image forming apparatus 100 is unable to perform idling without image formation, it may perform cleaning by forming an image close to the color of a sheet, for example, a white image if the color of a sheet is white, or a transparent clear image. In borderless printing, an image extending to outside a sheet is printed, and thus, a sheet of a size greater than that used for borderless printing may be used. The above-described cleaning processing may be performed for each sheet for borderless printing or for each print job.

If borderless printing is continuously performed with the same size of sheets, an increased time/amount of cleaning processing may not be performed. In this case, however, after performing final printing, an increased time/amount of cleaning processing is performed. If the size of a sheet in the current borderless printing is smaller than that in the previous borderless printing, an increased time/amount of cleaning processing may not be performed. In this case, however, after performing final printing, an increased time/amount of cleaning processing is performed. Conversely, if the size of a sheet in the current borderless printing is greater than that in the previous borderless printing, an increased time/amount of cleaning processing may be performed.

The printing restriction processing module 150 is connected to the borderless-printing control module 125. If a warning is issued by the warning module 140, the printing restriction processing module 150 restricts the use of the borderless printing function. Restricting of the use of the borderless printing function may be restricting of the number of usage times of the borderless printing function or restricting of a user using the borderless printing function. Restricting of the number of usage times is not to permit the use of the borderless printing function if the total number of usage times of the borderless printing function becomes equal to or greater than a predetermined threshold. Restricting of the number of usage times includes restricting of the number of print sheets, the number of usage times according to the sheet size, the number of usage times according to the monochrome printing, and the number of usage times according to the color printing. Restricting of a user using the borderless printing function is to permit the use of the borderless printing function only for a predetermined user. Restricting of a user using the borderless printing function includes restricting of a user according to the user identification (user ID) and restricting of a user according to the roll (a group leader, a designer, etc.). Restricting of the use of the borderless printing function may be a combination of restricting of the number of usage times of the borderless printing function and restricting of a user using the borderless printing function. For example, the number of usage times of the borderless printing function may be restricted according to the user ID.

The borderless-printing software checking module 155 is connected to the borderless-printing control module 125 and the borderless-printing software installing module 160. If a borderless-printing fixing device and a borderless-printing transfer device are set in the image forming processing module 110, the borderless-printing software checking module 155 checks whether software (program) for performing borderless printing is installed. As discussed above, the borderless-printing software checking module 155 may make a determination as to whether a borderless-printing fixing device and a borderless-printing transfer device are set, based on detection results of the borderless-printing fixing device detecting module 130 and the borderless-printing transfer device detecting module 135. The borderless-printing software checking module 155 may determine whether software for performing borderless printing is installed according to whether information (flag or attribute information) indicating that software is installed is stored in a predetermined storage region. Alternatively, the borderless-printing software checking module 155 may obtain a software ID for performing borderless printing from a software storage server 210 and determine whether the software ID is installed in the image forming processing module 110.

The borderless-printing software installing module 160 is connected to the borderless-printing software checking module 155 and the communication module 165. If the checking result obtained from the borderless-printing software checking module 155 indicates that software for performing borderless printing has not been installed, the borderless-printing software installing module 160 installs such software via a communication line. More specifically, the borderless-printing software installing module 160 searches the software storage server 210 for such software. In this case, the type of image forming apparatus 100 (and the device IDs of the borderless-printing fixing device and the borderless-printing transfer device depending on the situation) is used as a search key.

The communication module 165 is connected to the borderless-printing software installing module 160. The communication module 165 performs communication with the software storage server 210. More specifically, in response to an instruction from the borderless-printing software installing module 160, the communication module 165 requests the software storage server 210 to send software for performing borderless printing and receives such software.

Figure 2:
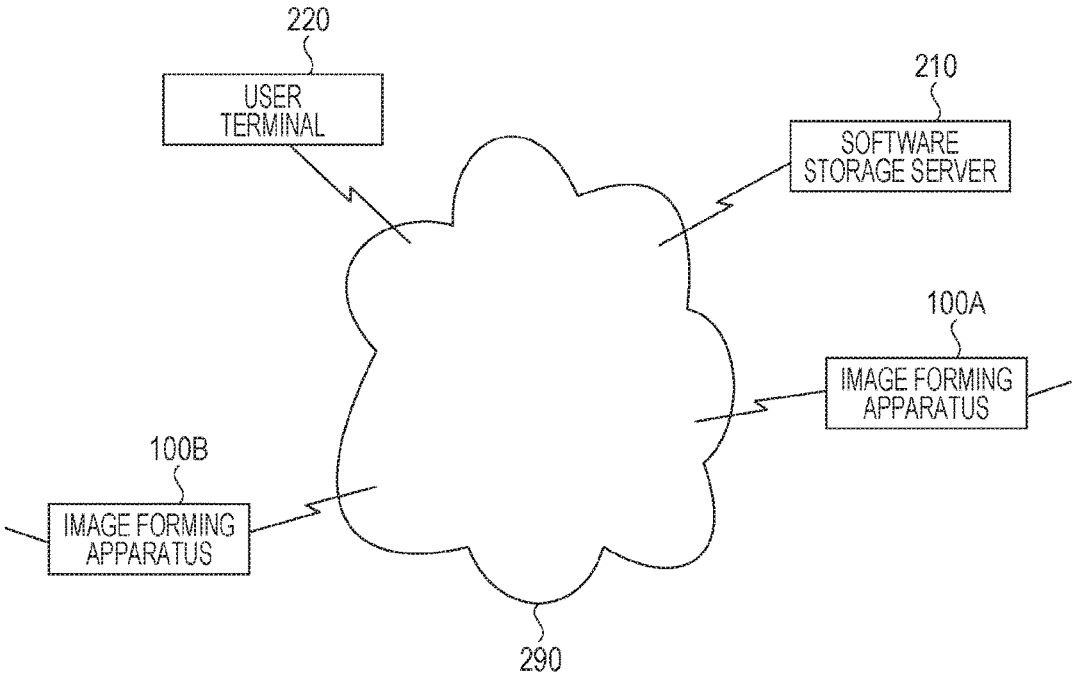
FIG. 2 is a block diagram illustrating an example of the configuration of a system utilizing the exemplary embodiment.

FIG. 2 is a block diagram illustrating an example of the configuration of a system utilizing the exemplary embodiment.

Image forming apparatuses 100A and 100B, the software storage server 210, and the user terminal 220 are connected to one another via a communication line 290. The communication line 290 may be a wireless or wired medium, or a combination thereof, and may be, for example, the Internet or an intranet as a communication infrastructure. Hereinafter, the image forming apparatuses 100A and 100B will simply be called the image forming apparatus 100 or the image forming apparatuses 100 unless it is necessary to distinguish them from each other. The user terminal 220 is a personal computer (notebook PC) or a mobile terminal having a communication function, and provides a print instruction to the image forming apparatus 100 in response to a user operation. The functions of the software storage server 210 may be implemented as cloud services.

When receiving a print instruction including an instruction to perform borderless printing from the user terminal 220, the image forming apparatus 100 varies processing to be executed according to whether a borderless-printing fixing device or a borderless-printing transfer device is set in the image forming apparatus 100. The image forming apparatus 100 also downloads software for performing borderless printing from the software storage server 210.

Figure 3:
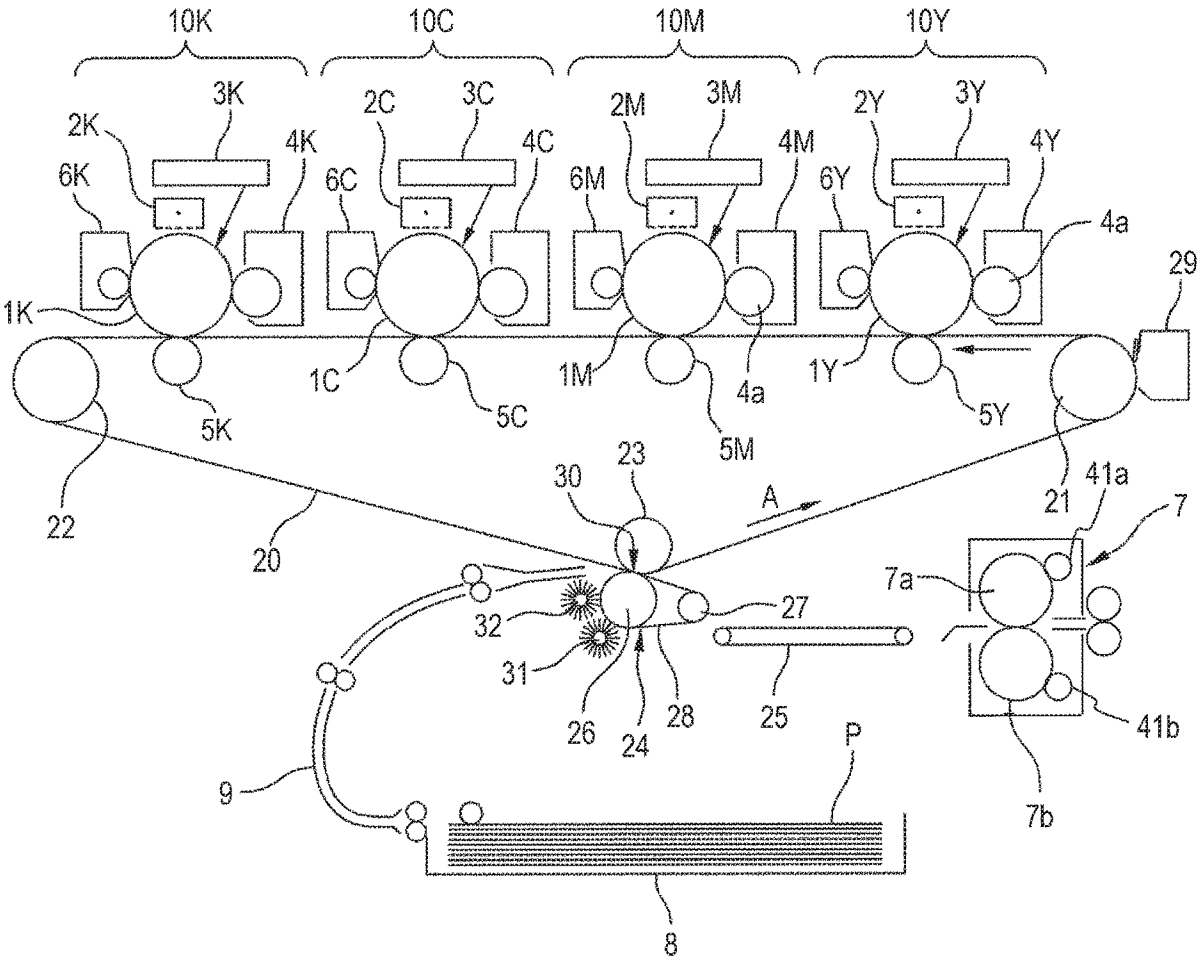
FIG. 3 is a schematic view of the inside of an image forming processing module.
Figure 4:
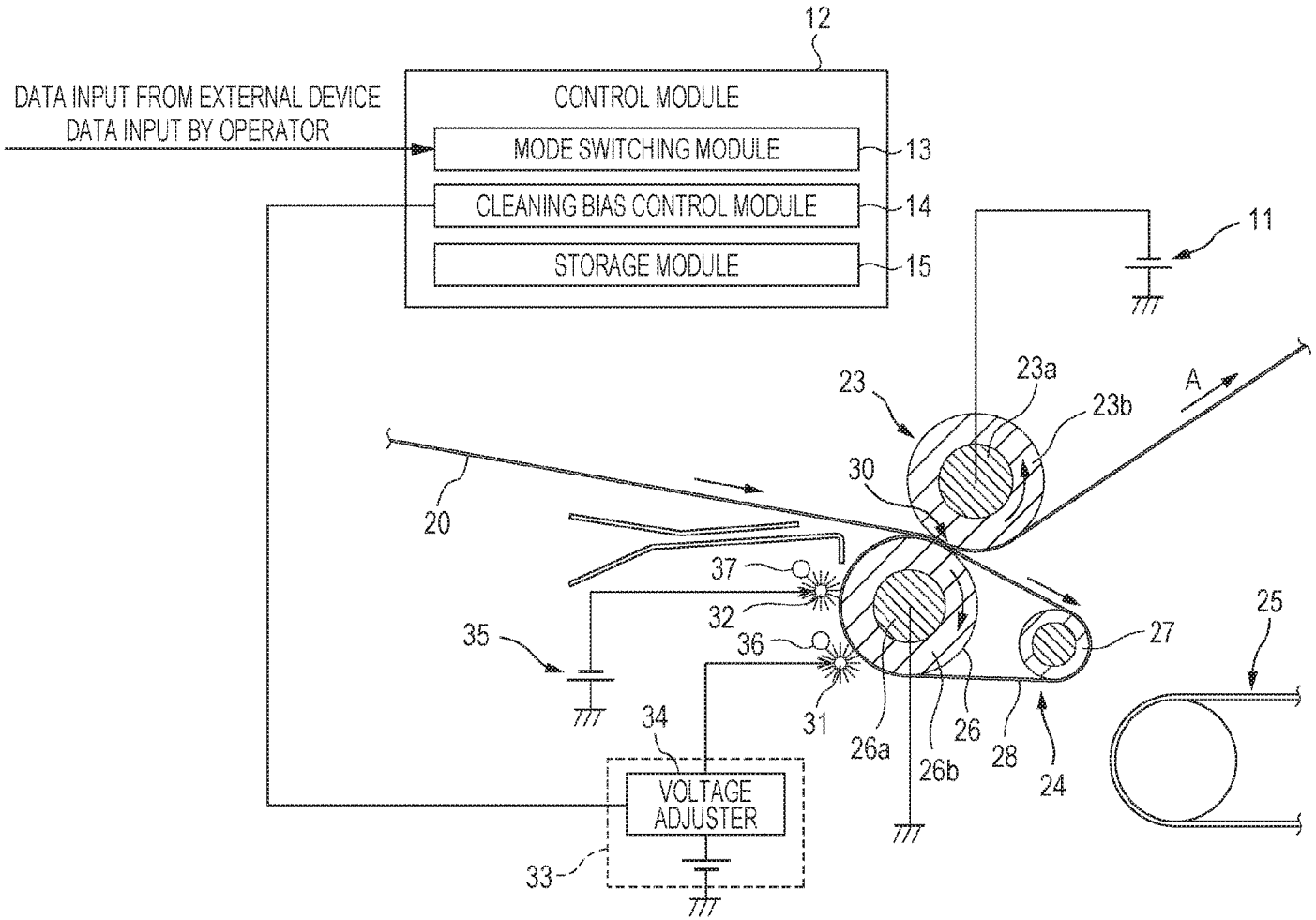
FIG. 4 illustrates the configuration of the image forming processing module at a position at which a second transfer operation is performed and the configuration in which a bias voltage is applied between a second transfer member and a cleaning member.

FIG. 3 is a schematic view of the inside of the image forming processing module 110. FIG. 4 illustrates the configuration of the image forming processing module 110 at a position at which a second transfer operation is performed and the configuration in which a bias voltage is applied between a second transfer member and a cleaning member.

An image forming apparatus forms a toner image by transferring powder toner to a latent image generated due to a difference in the electrostatic potential. In this type of image forming apparatus, a toner image is formed by transferring toner to the surface of a latent image carrier on which a latent image is formed. Then, the toner image is directly transferred from the latent image carrier to a recording medium, or is temporarily transferred from the latent image carrier to an intermediate transfer body in a first transfer operation and is then transferred to a recording medium in a second transfer operation. As a transfer member for transferring a toner image to a recording medium, a transfer belt which is formed in an endless shape and is rotated is typically used. The transfer belt is disposed in contact with the latent image carrier or the surface of the intermediate transfer body and is stretched on a transfer roller or plural roller-like members. Such a transfer member grips a recording medium which is fed to a transfer position where the transfer member opposes the latent image carrier or the intermediate transfer body, and allows the recording medium to pass while contacting the back side of the recording medium. By the application of a transfer bias voltage, an electric field is formed between the transfer member and the latent image carrier or the intermediate transfer body, thereby transferring the toner image to the recording medium within the electric field.

In this type of image forming apparatus, regular printing is normally performed in which a toner image is transferred to a recording medium with a margin left around the periphery of the recording medium. At the same time, image forming apparatuses that can perform borderless printing for transferring a toner image to the entire surface of a recording medium are being developed. In borderless printing, a toner image is formed in a range greater than the size of a recording medium, and the toner image covering the entire surface of the recording medium and extending to outside the recording medium is transferred. When performing borderless printing, toner extending from the recording medium is transferred to the surface of the transfer member at the transfer position.

On the latent image carrier, a small amount of toner leaks to outside a region where a toner image is formed. Such a toner is called "fog toner". In an image forming apparatus that directly transfers a toner image from a latent image carrier to a recording medium, such fog toner is transferred at the transfer position to the surface of a transfer member from a portion of the latent image carrier which does not oppose the recording medium. In an image forming apparatus that temporarily transfers a toner image from a latent image carrier to an intermediate transfer body in a first transfer operation and then transfers the toner image to a recording medium in a second transfer operation, fog toner is transferred to the intermediate transfer body at the first transfer position and is then transferred at the second transfer position to the surface of a transfer member from a portion of the intermediate transfer body which does not oppose the recording medium.

In this state, while the transfer member is being rotated, toner attached to the surface of the transfer member is transferred to the back side of a recording medium fed to the transfer position and makes the recording medium dirty. Japanese Unexamined Patent Application Publication No. 2008-89657, for example, discloses an image forming apparatus including a cleaning device for cleaning toner transferred to the surface of a transfer member.

The amount of toner transferred to the surface of a transfer member at a transfer position where the latent image carrier or the intermediate transfer body opposes the transfer member significantly varies according to whether regular printing or borderless printing is performed. The amount of toner may also vary according to the temperature or the humidity. Failing to remove toner from the surface of the transfer member makes the back side of a recording medium dirty.

The image forming processing module 110 reduces the possibility that the back side of a recording medium with a toner image will get dirty. This will be described below with reference to FIG. 3, assuming that a borderless-printing fixing device and a borderless-printing transfer device are set.

The image forming apparatus 100 forms a color image by using toners of four colors, for example. The image forming apparatus 100 includes electrophotographic-system image forming units 10Y, 10M, 10C, and 10K which output images of yellow (Y), magenta (M), cyan (C), and black (K), respectively, and an intermediate transfer belt 20 opposing the image forming units 10Y, 10M, 10C and 10K. Hereinafter, the image forming units 10Y, 10M, 10C and 10K will simply be called the image forming unit 10 or the image forming units 10 unless it is necessary to distinguish them from each other. The intermediate transfer belt 20 serves as an image carrier, and is disposed to oppose the image forming units 10. The intermediate transfer belt 20 is driven to rotate. On the downstream side of a position at which the intermediate transfer belt 20 opposes the image forming units 10 in the rotating direction of the intermediate transfer belt 20, a second transfer member 24 is disposed. The second transfer member 24 is used for a second transfer operation and is disposed to oppose the intermediate transfer belt 20. The second transfer member 24 serves as a transfer member. A sheet-like recording medium P is fed from a sheet storage unit 8 to a second transfer position 30 along a transport path 9, and a toner image on the intermediate transfer belt 20 is transferred to the recording medium P. At the second transfer position 30, the second transfer member 24 opposes the intermediate transfer belt 20. On the downstream side of the second transfer position 30 in the transport path of a recording medium, a transport device 25 and a fixing device 7 are disposed. The transport device 25 transports a recording medium with the toner image thereon. The fixing device 7 heats and pressurizes the recording medium so as to fix the toner image on the recording medium. On the farther downstream side, a discharged-sheet holding unit (not shown) that piles and holds recording mediums with fixed toner images is disposed.

On the downstream side of the second transfer position 30 in the rotating direction of the intermediate transfer belt 20, a cleaning device 29 for the intermediate transfer belt 20 is disposed. The cleaning device 29 recovers toner remaining on the intermediate transfer belt 20 after the second transfer operation. At a position which opposes the surface of a second transfer belt 28 (which will be discussed later) of the second transfer member 24, first and second cleaning members 31 and 32 for the second transfer member 24 are disposed. The first and second cleaning members 31 and 32 recover toner transferred from the intermediate transfer belt 20 to the second transfer member 24 at the second transfer position 30.

The image forming apparatus 100 has plural print modes including a regular print mode M1 and a borderless print mode M2. In the regular print mode M1, a toner image is formed on a recording medium with a margin left around the periphery of the recording medium. In the borderless print mode M2, a toner image is formed on the entire surface of a recording medium. The control module 12 switches between these print modes, based on data input from an external device or from an operation panel operated by an operator.

Concerning the image forming units 10, in order from the upstream side in the rotating direction of the intermediate transfer belt 20, the image forming unit 10Y for forming a yellow toner image, the image forming unit 10M for forming a magenta toner image, the image forming unit 10C for forming a cyan toner image, and the image forming unit 10K for forming a black toner image are arranged. Each image forming unit 10 includes a photoconductor drum 1 on which an electrostatic latent image is formed. Around the photoconductor drum 1, a charging device 2, a developing device 4, a first transfer roller 5, and a cleaning device 6 for the photoconductor drum 1 are provided. The charging device 2 charges the surface of the photoconductor drum 1. The developing device 4 selectively transfers toner to a latent image formed on the photoconductor drum 1 so as to form a toner image. The first transfer roller 5 transfers the toner image on the photoconductor drum 1 onto the intermediate transfer belt 20 in the first transfer operation. The cleaning device 6 removes toner remaining on the photoconductor drum 1 after the first transfer operation. An exposure device 3 is also disposed for each photoconductor drum 1. The exposure device 3 generates image light based on an image signal. On the upstream side of a position at which the developing device 4 opposes the photoconductor drum 1, the exposure device 3 applies image light to the photoconductor drum 1 so as to write an electrostatic latent image onto the photoconductor drum 1.

The photoconductor drum 1 is constituted by organic photoconductor layers stacked on each other around a cylindrical metallic member. The metallic member is electrically grounded. A bias voltage may be applied to the metallic member.

The charging device 2 includes an electrode wire disposed to oppose the surface of the photoconductor drum 1 with a space therebetween. A voltage is applied to the space between this electrode wire and the photoconductor drum 1 to generate a corona discharge therebetween, thereby charging the surface of the photoconductor drum 1.

In this exemplary embodiment, as the charging device 2, a charger using a corona discharge is used. However, a solid-state discharger may be used. Alternatively, a contact or non-contact charging device formed as a roller or a blade may be used.

The exposure device 3 generates blinking laser light based on an image signal and scans this laser light on the rotating photoconductor drum 1 in the main scanning direction (axial direction) by using a polygon mirror. As a result of the scanning operation, an electrostatic latent image of a corresponding color is formed on the surface of each photoconductor drum 1.

The developing device 4 uses a two-component developer containing toner and magnetic carrier. The developing device 4 includes a developing roller 4*a* at a position which opposes the photoconductor drum 1 and forms a two-component developer layer on the surface of the rotating developing roller 4*a*. Toner is transferred from the surface of the developing roller 4*a* onto the photoconductor drum 1 so as to visualize the electrostatic latent image. Toner consumed by the formation of toner images is refilled in accordance with the consumed amount.

In this exemplary embodiment, the photoconductor drum 1 is negatively charged by the charging device 2, and negatively charged toner is transferred to a portion of the photoconductor drum 1 where the charging potential is attenuated by the exposure device 3.

The first transfer roller 5 is provided for each image forming unit 10 and is disposed at the back side of the intermediate transfer belt 20 which opposes the photoconductor drum 1. A first-transfer bias voltage is applied between the first transfer roller 5 and the photoconductor drum 1, so that a toner image on the photoconductor drum 1 is electrostatically transferred to the rotating intermediate transfer belt 20 at a first transfer position between the first transfer roller 5 and the photoconductor drum 1.

The cleaning device 6 removes toner remaining on the photoconductor drum 1 after the first transfer operation by using a cleaning blade provided in contact with the surface of the photoconductor drum 1.

The intermediate transfer belt 20 is made of a film member formed in an endless shape constituted by plural layers superposed on each other. The intermediate transfer belt 20 serves as an image carrier and is stretched on a driven roller 21 which is driven to rotate, an adjustment roller 22, and an opposing roller 23. The adjustment roller 22 adjusts a displacement of the intermediate transfer belt 20 in the widthwise direction. The opposing roller 23 is supported at a position at which the opposing roller 23 opposes the second transfer member 24. The intermediate transfer belt 20 is rotated in the direction indicated by the arrow A in FIG. 3.

The second transfer member 24 is disposed at a position at which the second transfer member 24 opposes the opposing roller 23 with the intermediate transfer belt 20 therebetween. The second transfer member 24 includes a second transfer roller 26, an auxiliary roller 27, and a second transfer belt 28 stretched on the second transfer roller 26 and the auxiliary roller 27. The second transfer belt 28 is inserted between the opposing roller 23 and the second transfer roller 26 such that it is superposed on the intermediate transfer belt 20. The second transfer belt 28 is rotated in accordance with the rotation of the intermediate transfer belt 20. The second transfer belt 28 grips and transports a recording medium fed to a portion between the intermediate transfer belt 20 and the second transfer belt 28.

As shown in FIG. 4, the second transfer roller 26 is made by forming an outer peripheral layer 26*b* around the outer surface of a metal core 26*a*. The outer peripheral layer 26*b* is made of a rubber to which conductive particles are added. The opposing roller 23*a* is made by forming an outer peripheral layer 23*b* around the outer surface of a metal core 23*a*. The outer peripheral layer 23*b* may be constituted by a single layer or plural layers.

As shown in FIG. 4, a second-transfer bias voltage is applied from a transfer-bias power supply source 11 to a portion between the second transfer roller 26 and the opposing roller 23, thereby forming an electric field at the second transfer position 30.

The fixing device 7 heats and pressurizes a recording medium having a toner image transferred at the second transfer position 30 so as to fix the toner image on the recording medium. As shown in FIG. 3, the fixing device 7 includes a heating roller 7*a* having a built-in heating source and a pressurizing roller 7*b* pressed against the heating roller 7*a*. A recording medium with a toner image thereon is fed to a contact portion of the rotating heating roller 7*a* and pressurizing roller 7*b* and is heated and pressurized therebetween, thereby fixing the toner image on the recording medium. A cleaning member 41*a* is provided for the heating roller 7*a* to recover toner transferred to the heating roller 7*a*. A cleaning member 41*b* is provided for the pressurizing roller 7*b* to recover toner transferred to the pressurizing roller 7*b*. Cleaning in the fixing device is performed by the cleaning members 41*a* and 41*b*. The cleaning members 41*a* and 41*b* may be formed as rollers or blades.

The cleaning device 29 for the intermediate transfer belt 20 removes toner remaining on the surface of the intermediate transfer belt 20 after a toner image has been transferred to a recording medium. The cleaning device 29 includes a cleaning blade which contacts the surface of the intermediate transfer belt 20. The cleaning blade scrapes off toner attached to the surface of the intermediate transfer belt 20.

The first and second cleaning members 31 and 32 are disposed to contact the surface of the second transfer belt 28. Each of the first and second cleaning members 31 and 32 is formed by radially fixing a brush around a rotating metal shaft. The brush is made of a resin material with which particles are mixed for providing the conductivity. A voltage is applied from the rotating metal shaft to the brush so as to form an electric field between the brush and the second transfer roller 26. The first cleaning member 31 contacts the second transfer roller 26 on the upstream side in the rotating direction of the second transfer belt 28. A cleaning bias voltage is applied from a first cleaning bias power supply source 33 to between the first cleaning member 31 and the second transfer roller 26 which is electrically grounded, so that a positive potential can be provided to the first cleaning member 31. The second cleaning member 32 contacts the second transfer roller 26 on the downstream side in the rotating direction of the second transfer belt 28. A cleaning bias voltage is applied from a second cleaning bias power supply source 35 to between the second cleaning member 32 and the second transfer roller 26, so that a negative potential can be provided to the second cleaning member 32. The first cleaning member 31 with a positive potential primarily removes negatively charged toner from the surface of the second transfer belt 28. The second cleaning member 32 with a negative potential primarily removes positively charged toner from the surface of the second transfer belt 28.

Scraping members 36 and 37 shown in FIG. 4 respectively contact the brushes of the first and second cleaning members 31 and 32 so as to scrape off toner sucked from the surface of the second transfer belt 28 to the brushes of the first and second cleaning members 31 and 32.

The first cleaning member 31 serves as a cleaning member. The first cleaning bias power supply source 33 for applying a cleaning bias voltage to the first cleaning member 31 serves as a cleaning bias applying unit. This cleaning bias voltage is controlled by the control module 12.

The control module 12 includes a mode switching module 13, a cleaning bias control module 14, and a storage module 15. The mode switching module 13 switches to a print mode selected from among the plural print modes of the image forming apparatus 100. The cleaning bias control module 14 controls a cleaning bias voltage to be applied to the first cleaning member 31. The control module 12 has a function of controlling the image forming apparatus 100 performing an operation for forming an image on a recording medium.

The mode switching module 13 serves as a print mode switching unit. The mode switching module 13 selects one of the plural print modes, such as the regular print mode M1 and the borderless print mode M2, based on information input from an external device or from an operation panel operated by an operator, and performs control so that an image is formed in accordance with the selected print mode.

The cleaning bias control module 14 serves as a bias voltage controller. The cleaning bias control module 14 controls the value of a voltage to be applied from the first cleaning bias power supply source 33 to the first cleaning member 31, based on the print mode selected by the mode switching module 13. That is, the cleaning bias control module 14 operates a voltage adjuster 34 of the first cleaning bias power supply source 33 so that a first bias voltage V1 will be applied to the first cleaning member 31 when the regular print mode M1 is selected and so that a second bias voltage V2 will be applied to the first cleaning member 31 when the borderless print mode M2 is selected.

The first and second bias voltages V1 and V2 are preset and stored in the storage module 15. The second bias voltage V2 for the borderless print mode M2 is set so that a potential difference between the second transfer roller 26 and the first cleaning member 31 will become greater than when the first bias voltage V1 for the regular print mode M1 is set.

In this exemplary embodiment, the first and second bias voltages V1 and V2 are preset constant values. However, the first and second bias voltages V1 and V2 may be controlled based on other conditions, for example, environmental conditions such as the temperature and the humidity, in addition to the print mode. When the other conditions, such as environmental conditions, are the same, the second bias voltage V2 used for the borderless print mode M2 is set so that the potential difference between the second transfer roller 26 and the first cleaning member 31 will become greater than when the first bias voltage V1 used for the regular print mode M1 is set.

The image forming apparatus 100 is operated as follows.

Electrostatic latent images are formed on the four photoconductor drums 1, and toner images are formed by transferring toner from the developing devices 4 to the photoconductor drums 1. These toner images are transferred to the intermediate transfer belt 20 at positions at which the first transfer rollers 5 oppose the intermediate transfer belt 20, so that the superposed toner image can be formed on the intermediate transfer belt 20. As the intermediate transfer belt 20 is rotated, the superposed toner image is transported to the second transfer position 30 and is transferred from the intermediate transfer belt 20 to a recording medium P.

When the above-described image forming operation is performed in the regular print mode M1, a toner image is formed in a range smaller than the size of a recording medium, and is transferred at the second transfer position 30 to the recording medium with a margin left around the periphery of the recording medium. A small amount of so-called fog toner is likely to be attached to a portion of the intermediate transfer belt 20 without a toner image thereon, for example, to a non-image region between a region of the intermediate transfer belt 20 with a toner image and a region of the intermediate transfer belt 20 with the next toner image. Fog toner attached to a region of the intermediate transfer belt 20 which does not oppose a recording medium at the second transfer position 30 is transferred to the second transfer belt 28 at the second transfer position 30. The second transfer belt 28 is rotated and passes a position opposing the first cleaning member 31 to which the first bias voltage V1 is applied and a position opposing the second cleaning member 32. Part of toner remaining on the second transfer belt 28 is removed by the first and second cleaning members 31 and 32. Part of toner on the second transfer belt 28 is not removed by the first and second cleaning members 31 and 32 and remains. However, the amount of toner remaining on the second transfer belt 28 is small, and the back side of the recording medium does not get dirty in a short period of time.

In contrast, when the above-described image forming operation is performed in the borderless print mode M2, a toner image is formed in a range greater than the size of a recording medium. The toner image is transferred to the recording medium at the second transfer position 30 by extending to outside the recording medium. The toner extending from the recording medium is transferred to the second transfer belt 28. The amount of toner attached to the second transfer belt 28 is much greater than that of the so-called fog toner in the regular print mode M1. Additionally, fog toner is also attached from a non-image region of the intermediate transfer belt 20 to the second transfer belt 28, as in the regular print mode M1. The second transfer belt 28 is rotated and passes a position opposing the first cleaning member 31 and a position opposing the second cleaning member 32. Part of toner remaining on the second transfer belt 28 is removed by the first and second cleaning members 31 and 32. The second bias voltage V2 is applied to the first cleaning member 31. As discussed above, the second bias voltage V2 is set so that the potential difference between the first cleaning member 31 and the second transfer roller 26 will become greater than when the first bias voltage V1 is set. The first cleaning member 31 is provided with a positive potential, and thus, a large amount of negatively charged toner attached to the second transfer belt 28 is primarily removed by the first cleaning member 31. The transfer device is cleaned by the first and second cleaning members 31 and 32. The first and second cleaning members 31 and 32 may be formed as brushes, rollers, or blades.

In the borderless print mode M2, if toner extending to outside a recording medium and attached to the second transfer belt 28 is not removed by a cleaning operation at one time, it may be attached to the back side of the recording medium.

Figure 5A:
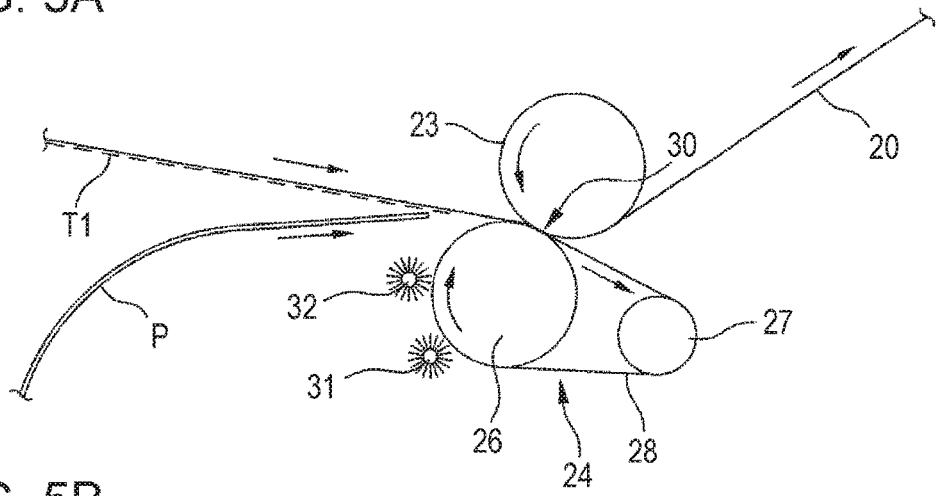
FIGS. 5A, 5B, and 5C illustrate a state in which the back side of a recording medium gets dirty by a toner image extending to outside the recording medium in borderless printing.
Figure 5B:
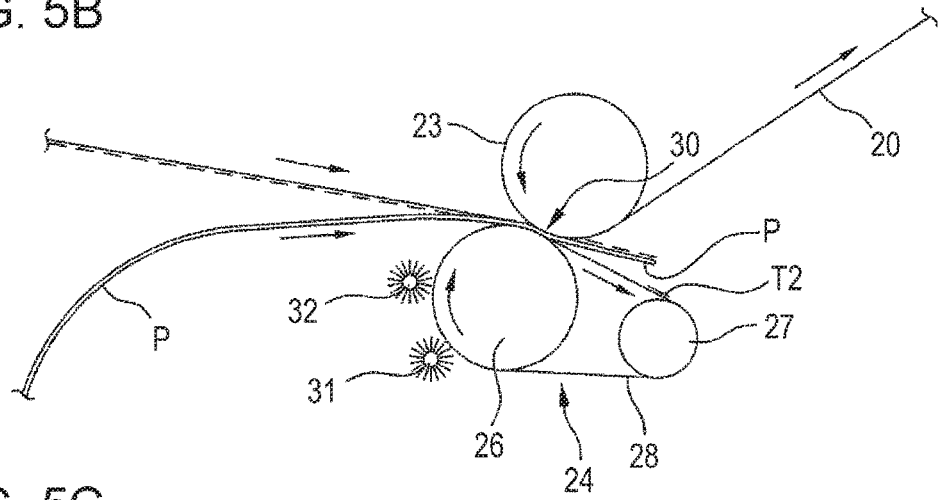
Figure 5C:
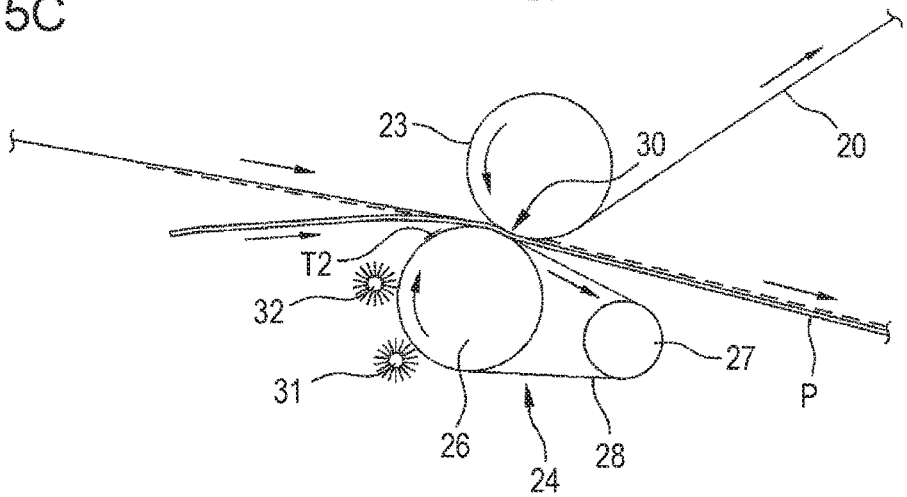

FIGS. 5A, 5B, and 5C illustrate a state in which the back side of a recording medium gets dirty by a toner image extending to outside the recording medium in borderless printing.

As shown in FIG. 5A, in the borderless print mode M2, a toner image T1 transferred onto the intermediate transfer belt 20 is greater than the size of a recording medium P, and extends from the forward side of the recording medium P at the second transfer position 30. The toner extending from the forward side of the recording medium P is transferred to the second transfer belt 28 as remaining toner T2 when passing the second transfer position 30, as shown in FIG. 5B. As the second transfer belt 28 is rotated, it passes a position opposing the first cleaning member 31 and a position opposing the second cleaning member 32. If the remaining toner T2 is not removed by the first and second cleaning members 31 and 32, it reaches the second transfer position 30 again. If the length of the second transfer belt 28 is smaller than that of the recording medium P in the transport direction, the rear side of the recording medium P in the transport direction is still located at the second transfer position 30 when the remaining toner T2 reaches the second transfer position 30, as shown in FIG. 5C. As a result, the remaining toner T2 is attached to the back side of the recording medium P.

In the borderless print mode M2, it is therefore necessary to remove the remaining toner T2 attached to the second transfer belt 28 while the second transfer belt 28 is passing positions opposing the first and second cleaning members 31 and 32 one time. In this case, the remaining toner T2 has to be removed at least to such a degree as to make the back side of the recording medium P look sufficiently clean.

Figure 6:
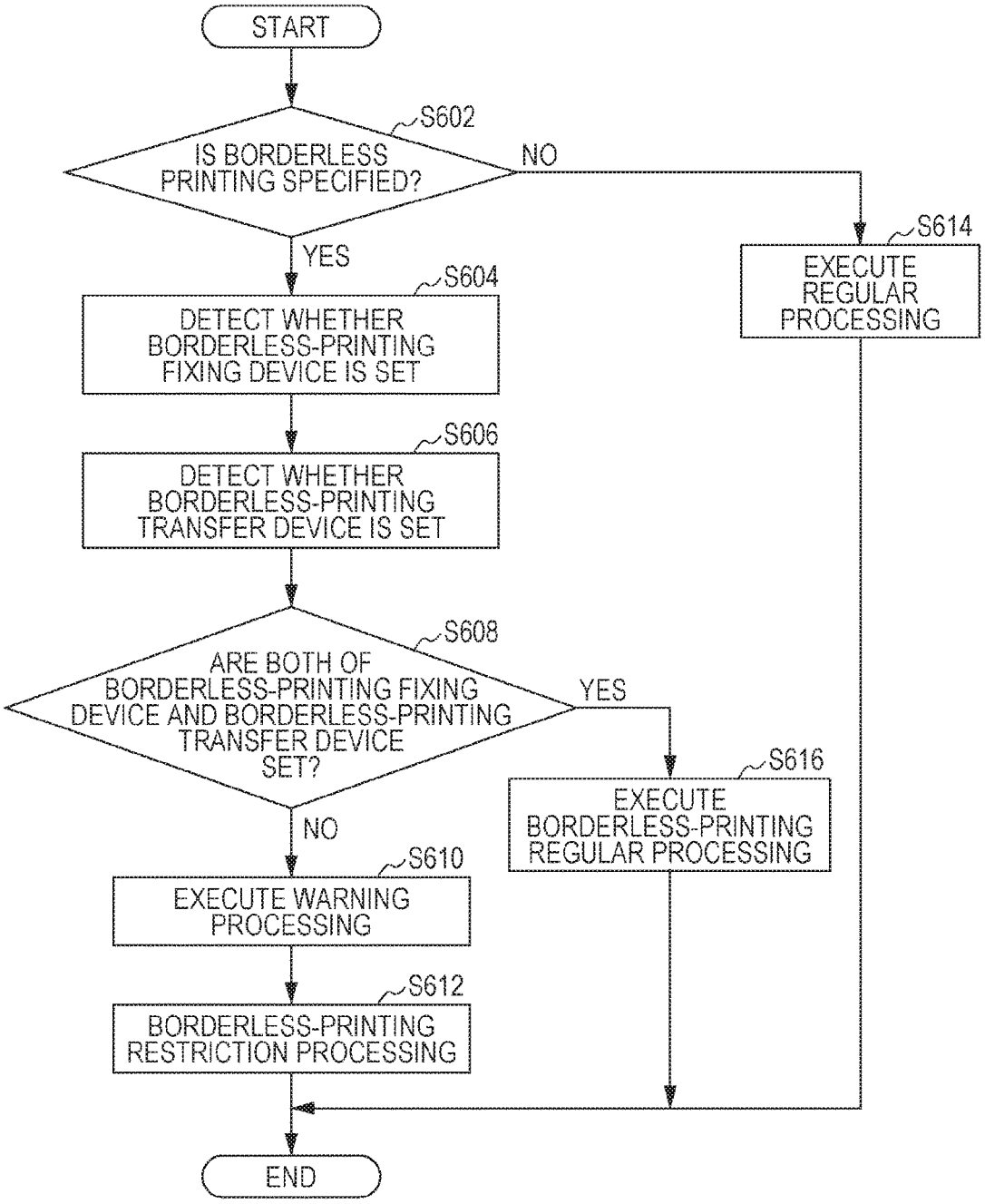
FIG. 6 is a flowchart illustrating an example of processing executed in the exemplary embodiment.

FIG. 6 is a flowchart illustrating an example of processing executed in this exemplary embodiment, and more specifically, processing executed primarily by the borderless control module 120.

In step S602, the borderless-printing control module 125 determines whether borderless printing is specified. If borderless printing is specified, the process proceeds to step S604. If borderless printing is not specified, the process proceeds to step S614.

In step S604, the borderless-printing fixing device detecting module 130 detects whether a borderless-printing fixing device is set.

In step S606, the borderless-printing transfer device detecting module 135 detects whether a borderless-printing transfer device is set.

In step S608, the warning module 140 determines whether both of the borderless-printing fixing device and the borderless-printing transfer device are set. If the result of step S608 is YES, the process proceeds to step S616. If the result of step S608 is NO, the process proceeds to step S610.

In step S610, the warning module 140 executes warning processing.

In step S612, the printing restriction processing module 150 executes borderless-printing restriction processing. Detailed processing in step S612 will be discussed later with reference to the flowchart in FIG. 8.

In step S614, the image forming processing module 110 executes regular processing, for example, border printing processing.

In step S616, the image forming processing module 110 executes borderless-printing regular processing.

Figure 7A:
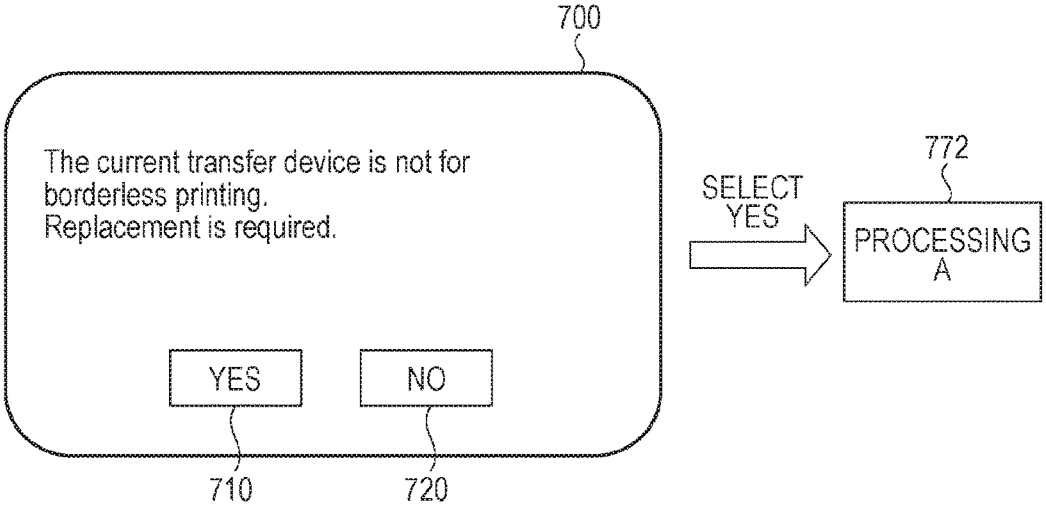
FIGS. 7A and 7B illustrate an example of processing executed in the exemplary embodiment.
Figure 7B:
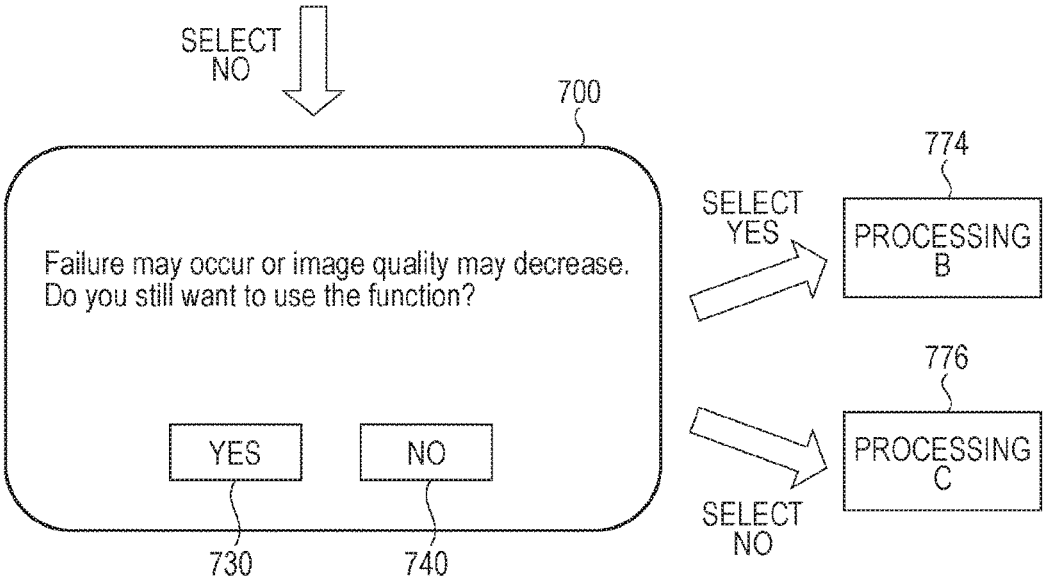

FIGS. 7A and 7B illustrate an example of processing executed in this exemplary embodiment, and more particularly, an example of step S610 in FIG. 6.

In the example in FIG. 7A, "The current transfer device is not for borderless printing. Replacement is required." is displayed on a screen 700. A "YES" button 710 and a "NO" button 720 are displayed. If a user selects the "YES" button 710, processing A 772 is executed. If the user selects the "NO" button 720, a message shown in FIG. 7B is displayed.

An example of the content of the processing A 772 is as follows. If the replacement of the transfer device succeeds, an error message is not displayed, or a message that the user is now ready to use the borderless printing function is displayed, and the borderless printing function is enabled. In the flowchart of FIG. 6, the processing A 772 corresponds to step S616 after the result of step S608 has become YES.

In the example in FIG. 7B, "Failure may occur or the image quality may decrease. Do you still want to use the function?" is displayed on the screen 700. A "YES" button 730 and a "NO" button 740 are displayed. If a user selects the "YES" button 730, processing B 774 is executed. If the user selects the "NO" button 740, processing C 776 is executed.

An example of the content of the processing B 774 is as follows. The use of the borderless printing function is permitted with some limitations. For example, the use of the borderless printing function is limited only to a current job or the user of this job. After finishing printing of this job or by this user, the borderless printing function is disabled. In the flowchart in FIG. 6, the processing B 774 corresponds to step S612.

An example of the content of the processing C 776 is as follows. The screen 700 is returned to the home screen, or a warning screen is displayed again.

If only one of the borderless-printing fixing device and the borderless-printing transfer device is set, the use of the borderless printing function may be permitted with some limitations. If neither of the borderless-printing fixing device nor the borderless-printing transfer device is set, the use of the borderless printing function may be prohibited.

Figure 8:
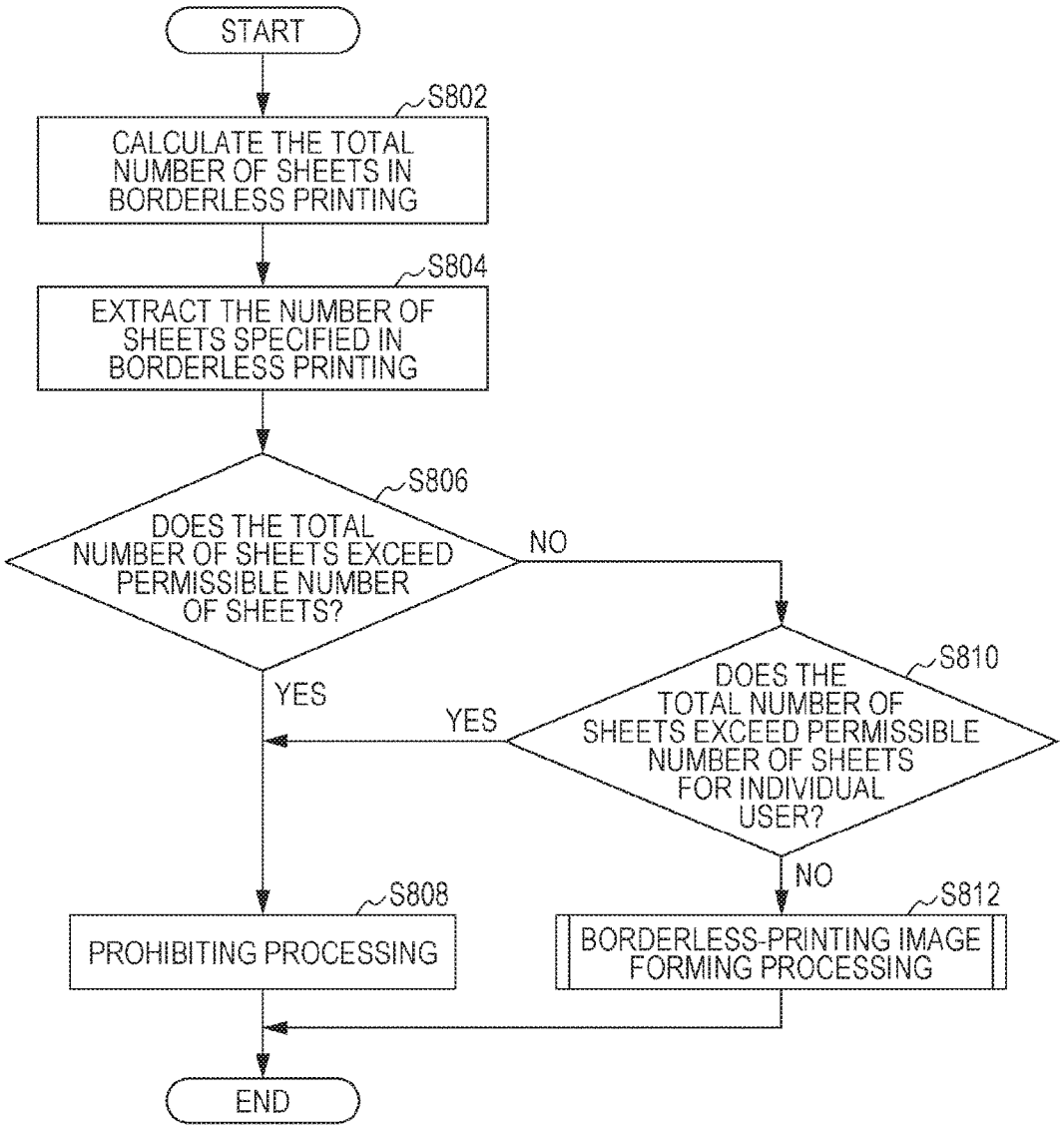
FIG. 8 is a flowchart illustrating an example of processing executed in the exemplary embodiment.

FIG. 8 is a flowchart illustrating an example of processing executed in this exemplary embodiment.

In step S802, the total number of sheets used in borderless printing is calculated. As discussed above, the total number of sheets used in borderless printing may be calculated according to the user or the sheet size. In this case, a borderless-printing log table 900 may be used. FIG. 9 illustrates an example of the data structure of the borderless-printing log table 900. The borderless-printing log table 900 includes a date field 910, a number-of-sheets field 920, a sheet size field 930, a monochrome/color field 940, and a user field 950. The borderless-printing log table 900 records a borderless-printing history (log) in a state in which a borderless-printing fixing device or a borderless-printing transfer device is not set. In the date field 910, the date on which borderless printing is performed is stored. In the number-of-sheets field 920, the number of sheets used in this borderless printing is stored. In the sheet size field 930, the sheet size used in this borderless printing is stored. In the monochrome/color field 940, information that this borderless printing is monochrome printing or color printing is stored. In the user field 950, the user (user ID) performed this borderless printing is stored.

In step S804, the number of sheets specified in borderless printing is extracted.

In step S806, it is determined whether the total number of sheets in borderless printing exceeds a permissible number. If the total number of sheets exceeds the permissible number, the process proceeds to step S808. If the total number of sheets does not exceed the permissible number, the process proceeds to step S810. The permissible number is a threshold indicating a preset number of sheets that the image forming apparatus 100 is capable of performing borderless printing without a borderless-printing fixing device or a borderless-printing transfer device.

In step S808, prohibiting processing is executed. For example, a message that it is not possible to perform borderless printing is displayed.

In step S810, it is determined whether the total number of sheets in borderless printing exceeds a permissible number of sheets for an individual user. If the total number of sheets exceeds the permissible number of sheets for an individual user, the process proceeds to step S808. If the total number of sheets does not exceed the permissible number of sheets for an individual user, the process proceeds to step S812. The permissible number of sheets for an individual user may be determined by using a user permissible-number-of-sheets table 1000. FIG. 10 illustrates an example of the data structure of the user permissible-number-of-sheets table 1000. The user permissible-number-of-sheets table 1000 includes a user field 1010 and a permissible-number-of-sheets field 1020. In the user field 1010, a user (user ID) is stored. In the permissible-number-of-sheets field 1020, the permissible number of sheets in borderless printing for this user is stored. Although in this example the permissible number of sheets is set according to the user, it may be set according to the sheet size.

In step S812, borderless-printing image forming processing is executed. Detailed processing in step S812 will be discussed below with reference to the flowchart in FIG. 11.

Figure 11:
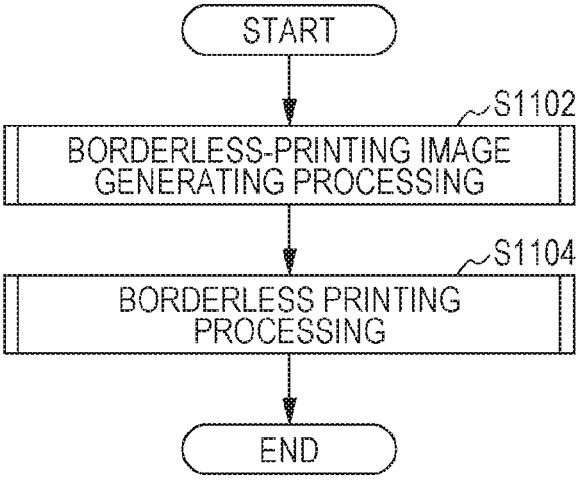
FIG. 11 is a flowchart illustrating an example of processing executed in the exemplary embodiment.

FIG. 11 is a flowchart illustrating an example of processing executed in this exemplary embodiment.

In step S1102, processing for generating a borderless printing image is executed. Detailed processing in step S1102 will be discussed later with reference to the flowchart in FIG. 12.

In step S1104, borderless printing processing is executed. Detailed processing in step S1104 will be discussed later with reference to the flowchart in FIG. 13.

Figure 12:
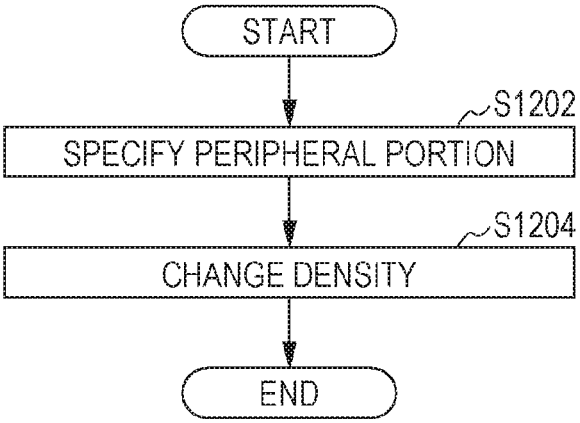
FIG. 12 is a flowchart illustrating an example of processing executed in the exemplary embodiment.

FIG. 12 is a flowchart illustrating an example of processing executed in this exemplary embodiment.

In step S1202, a peripheral portion of a sheet is specified. For example, a predetermined region (portion having a predetermined width from a border) is specified.

In step S1204, the density is changed. For example, instead of uniformly reducing the density in the peripheral portion, the degree by which the density is reduced may be increased toward the border.

Figure 13:
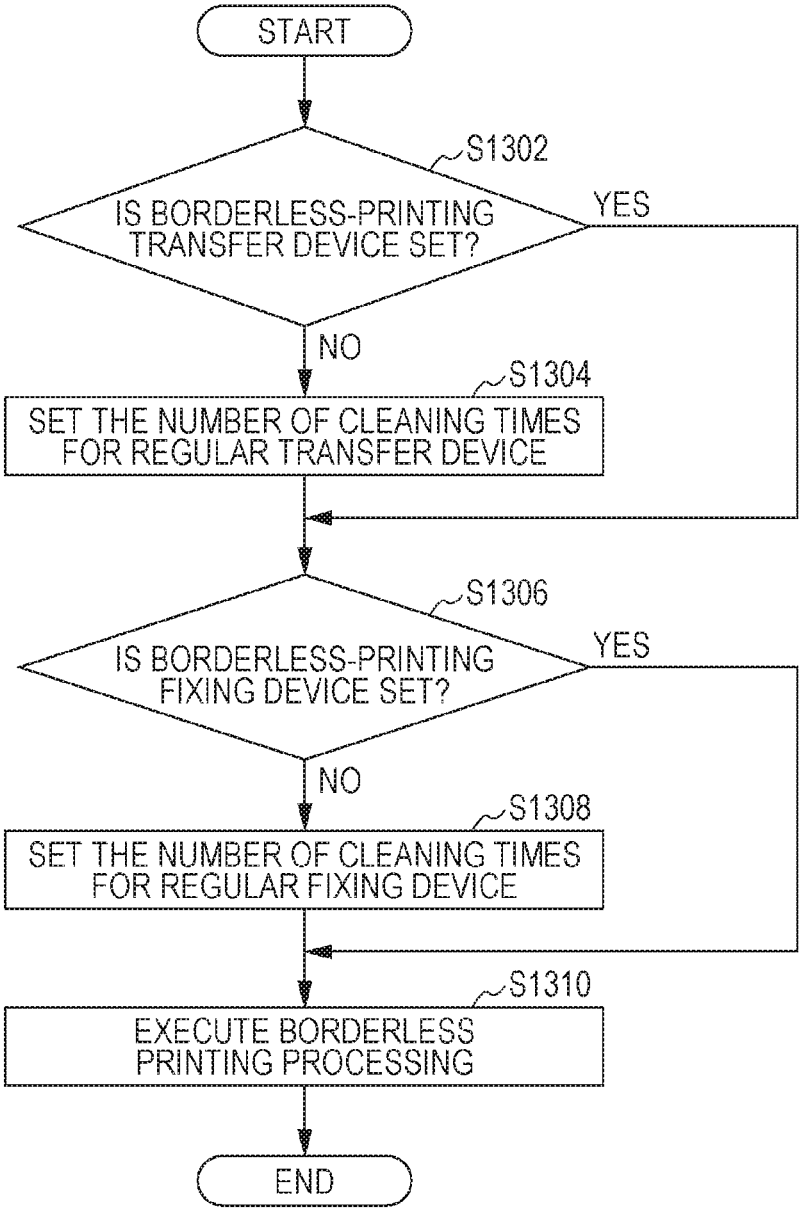
FIG. 13 is a flowchart illustrating an example of processing executed in the exemplary embodiment.

FIG. 13 is a flowchart illustrating an example of processing executed in this exemplary embodiment.

In step S1302, it is determined whether a borderless-printing transfer device is set. If a borderless-printing transfer device is not set, the process proceeds to step S1304. If a borderless-printing transfer device is set, the process proceeds to step S1306.

In step S1304, the number of times that the regular transfer device will be cleaned is set.

In step S1306, it is determined whether a borderless-printing fixing device is set. If a borderless-printing fixing device is not set, the process proceeds to step S1308. If a borderless-printing fixing device is set, the process proceeds to step S1310.

In step S1308, the number of times that the regular fixing device will be cleaned is set.

In step S1310, borderless printing processing is executed.

Figure 14:
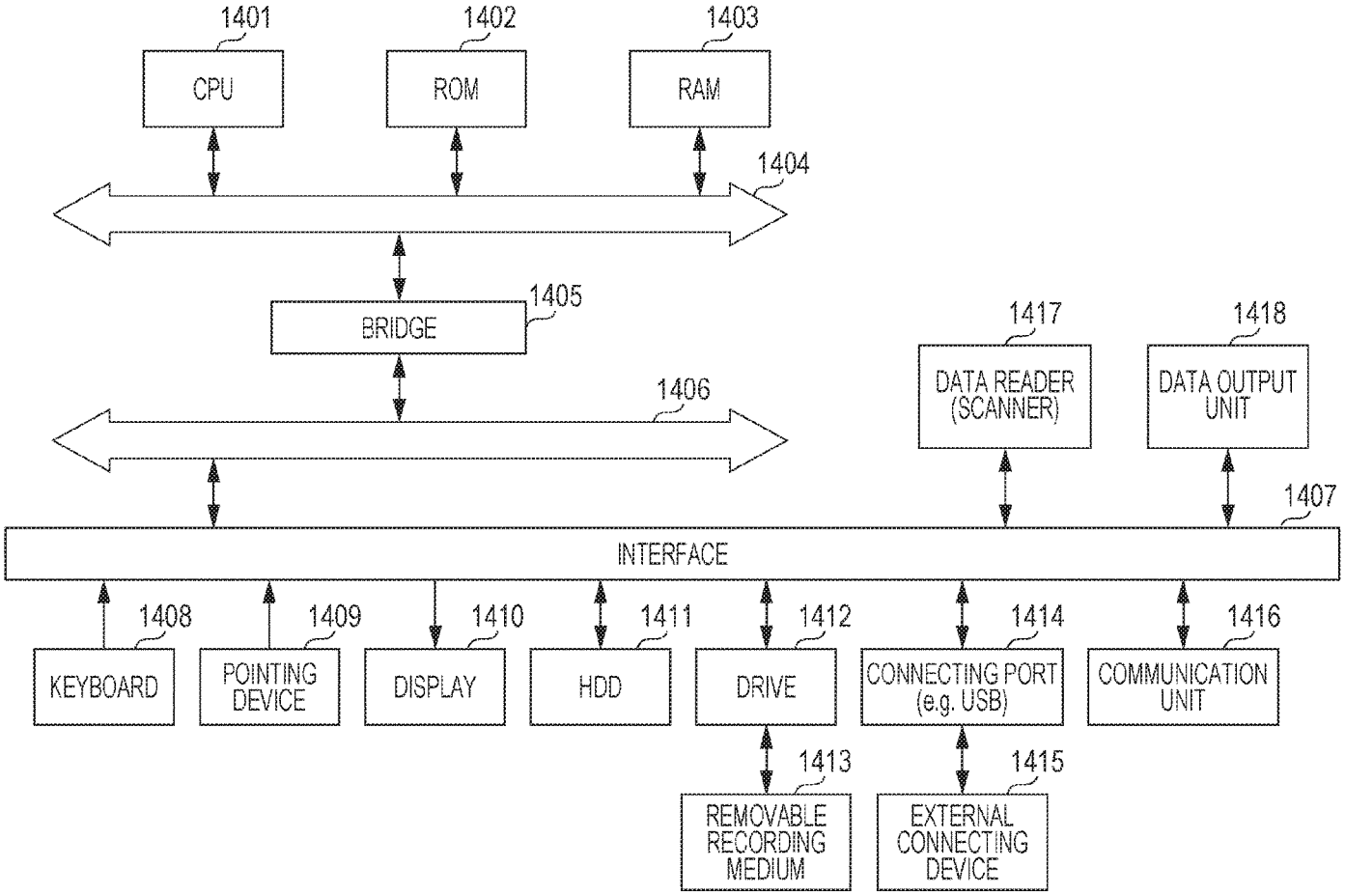
FIG. 14 is a block diagram illustrating an example of the hardware configuration of a computer implementing the exemplary embodiment.

An example of the hardware configuration of the image forming apparatus 100 of this exemplary embodiment will be described below with reference to FIG. 14. The hardware configuration shown in FIG. 14 is implemented as a personal computer (PC), for example, and includes a data reader 1417, such as a scanner, and a data output unit 1418, such as a printer.

A CPU 1401 is a control unit that executes processing in accordance with a computer program describing an execution sequence of the modules of the above-described exemplary embodiment, that is, the control module 12, the borderless-printing control module 125, the borderless-printing fixing device detecting module 130, the borderless-printing transfer device detecting module 135, the warning module 140, the borderless image forming processing module 145, the printing restriction processing module 150, the borderless-printing software checking module 155, the borderless-printing software installing module 160, and the communication module 165.

A read only memory (ROM) 1402 stores programs and operation parameters used by the CPU 1401. A RAM 1403 stores programs used during the execution of the CPU 1401 and parameters which change appropriately during the execution of the programs. The CPU 1401, the ROM 1402, and the RAM 1403 are connected to one another via a host bus 1404, which is constituted by, for example, a CPU bus.

The host bus 1404 is connected to an external bus 1406, such as a peripheral component interconnect/interface (PCI) bus, via a bridge 1405.

A keyboard 1408 and a pointing device 1409, such as a mouse, are devices operated by an operator. A display 1410 is, for example, a liquid crystal display or a cathode ray tube (CRT), and displays various items of information as text or image information. Alternatively, a touch screen having both of the functions of the pointing device 1409 and the display 1410 may be provided.

A hard disk drive (HDD) 1411 has a built-in hard disk (may alternatively be a flash memory, for example) and drives the hard disk so as to record or play back information or programs executed by the CPU 1401. In the hard disk, the borderless-printing log table 900 and the user permissible-number-of-sheets table 1000 are stored. Various other items of data and various other computer programs are also stored in the hard disk.

A drive 1412 reads data or a program recorded in a removable recording medium 1413, such as a magnetic disk, an optical disc, a magneto-optical disk, or a semiconductor memory, and supplies the read data or program to the RAM 1403 via an interface 1407, the external bus 1406, the bridge 1405, and the host bus 1404. The removable recording medium 1413 is also usable as a data recording region.

A connecting port 1414 is a port for connecting the PC to an external connecting device 1415, and has a connecting portion, such as a USB port or an IEEE1394 port. The connecting port 1414 is connected to, for example, the CPU 1401, via the interface 1407, the external bus 1406, the bridge 1405, and the host bus 1404. A communication unit 1416 is connected to a communication line and executes data communication processing with an external source. The data reader 1417 is, for example, a scanner, and executes processing for reading documents. The data output unit 1418 is, for example, a printer, and executes processing for outputting document data.

The hardware configuration of the image forming apparatus 100 shown in FIG. 14 is only an example, and the image forming apparatus 100 may be configured in any manner in which the modules described in the exemplary embodiment are executable. For example, some modules may be configured as dedicated hardware (for example, an application specific integrated circuit (ASIC)), or some modules may be installed in an external system and be connected to the image forming apparatus 100 via a communication line. Alternatively, a system, such as that shown in FIG. 14, may be connected to a system, such as that shown in FIG. 14, via a communication line, and may be operated in cooperation with each other.

In the above-described exemplary embodiment, the image forming apparatus 100 forms a color image by using toners of four colors. However, the image forming apparatus 100 may perform monochrome printing, or may form a color image by using toners of three or five or more colors.

In the above-described exemplary embodiment, plural photoconductor drums are used. However, one photoconductor drum is used to form an image.

The above-described program may be stored in a recording medium and be provided. The program recorded on a recording medium may be provided via a communication medium. In this case, the above-described program may be implemented as a "non-transitory computer readable medium storing the program therein" in the exemplary embodiment of the invention.

The "non-transitory computer readable medium storing a program therein" is a recording medium storing a program therein that can be read by a computer, and is used for installing, executing, and distributing the program.

Examples of the recording medium are digital versatile disks (DVDs), and more specifically, DVDs standardized by the DVD Forum, such as DVD-R, DVD-RW, and DVD-RAM, DVDs standardized by the DVD+RW Alliance, such as DVD+R and DVD+RW, compact discs (CDs), and more specifically, a read only memory (CD-ROM), a CD recordable (CD-R), and a CD rewritable (CD-RW), Blu-ray (registered trademark) disc, a magneto-optical disk (MO), a flexible disk (FD), magnetic tape, a hard disk, a ROM, an electrically erasable programmable read only memory (EEPROM) (registered trademark), a flash memory, a RAM, a secure digital (SD) memory card, etc.

The entirety or part of the above-described program may be recorded on such a recording medium and stored therein or distributed. Alternatively, the entirety or part of the program may be transmitted through communication by using a transmission medium, such as a wired network used for a local area network (LAN), a metropolitan area network (MAN), a wide area network (WAN), the Internet, an intranet, or an extranet, a wireless communication network, or a combination of such networks. The program may be transmitted by using carrier waves.

The above-described program may be the entirety or part of another program, or may be recorded, together with another program, on a recording medium. The program may be divided and recorded on plural recording media. Further, the program may be recorded in any form, for example, it may be compressed or encrypted in a manner such that it can be reconstructed.

The above-described exemplary embodiment may be combined with the following image forming apparatus.

(a) An image forming apparatus including:

an image carrier that carries a toner image;

a transfer member that is formed in an endless shape and is disposed such that a surface of the transfer member opposes the image carrier while the transfer member is being rotated, an electric field being formed between the transfer member and the image carrier, the electric field being used for transferring the toner image to a recording medium which passes between the transfer member and the image carrier;

a cleaning member that is disposed in contact with the surface of the transfer member and removes toner attached to the surface of the transfer member;

a cleaning bias applying unit that applies a cleaning bias voltage to between the cleaning member and the transfer member;

a print mode switching unit that selects one of plural print modes including a borderless print mode and a regular print mode, the toner image being transferred to an entire surface of a recording medium in the borderless print mode, the toner image being transferred to a recording medium with a margin left around a periphery of the recording medium in the regular print mode; and a bias voltage controller that performs control so that the cleaning bias voltage applied by the cleaning bias applying unit will be a first bias voltage in the regular print mode and so that the cleaning bias voltage will be a second bias voltage in the borderless print mode, a potential difference between the cleaning member and the transfer member being greater when the second bias voltage is applied than when the first bias voltage is applied, wherein, when continuously performing image formation in the borderless print mode, plural borderless images are formed until a predetermined condition is met, and then, the second bias voltage applied to between the cleaning member and the transfer member is switched to the first bias voltage, and the transfer member is driven to rotate while the first bias voltage is being applied to between the cleaning member and the transfer member.

(b) The image forming apparatus according to (a), wherein, when continuously performing image formation in the borderless print mode, the second bias voltage is switched to the first bias voltage, and the transfer member is driven to rotate while the first bias voltage is being applied to between the cleaning member and the transfer member, and then, image formation in the borderless print mode is restarted by switching the first bias voltage to the second bias voltage.

In the image forming apparatus according to (a), when image formation is continuously performed in the borderless print mode, it is less likely that the back side of a recording medium with a toner image thereon will get dirty by toner remaining on the transfer member than in an image forming apparatus without the configuration of the image forming apparatus according to (a).

In the image forming apparatus according to (b), when image formation is continuously performed in the borderless print mode, it is less likely that the back side of a recording medium with a toner image thereon will get dirty by toner remaining on the transfer member than in an image forming apparatus without the configuration of the image forming apparatus according to (b).

The above-described exemplary embodiment may be interpreted as follows.

To perform high-quality borderless printing with an image forming apparatus, a regular transfer device and a regular fixing device are required to be replaced by a special transfer device and a special fixing device. More specifically, a device having a special cleaning mechanism is necessary. Without a borderless-printing transfer device or a borderless-printing fixing device, the image forming apparatus is still able to perform borderless printing. However, this may decrease the image quality or cause a failure in the image forming apparatus.

It is an object of this exemplary embodiment to provide an image forming apparatus and a non-transitory computer readable medium in which a user can be informed that a borderless-printing transfer device or a borderless-printing fixing device is not set.

[A1] An image forming apparatus including:

a warning unit that issues a warning in the case of using a borderless printing function if a border-printing fixing device and a borderless-printing fixing device are replaceable by each other or a border-printing transfer device and a borderless-printing transfer device are replaceable by each other and if a fixing device set in the image forming apparatus is not a borderless-printing fixing device or if a transfer device set in the image forming apparatus is not a borderless-printing transfer device, wherein, if the warning is issued, the number of times of use for the borderless printing function or a user using the borderless printing function is restricted.

[A2] An image forming apparatus including:

an image forming processing unit that performs image forming processing upon receiving an instruction to use a borderless printing function in a state in which a borderless-printing fixing device or a borderless-printing transfer device is not set in the image forming apparatus, the image forming processing being different from image forming processing performed when a borderless-printing fixing device and a borderless-printing transfer device are set in the image forming apparatus.

[A3] The image forming apparatus according to [A2], wherein the image forming processing unit performs the different image forming processing by reducing density of an image in a border.

[A4] The image forming apparatus according to [A2], wherein the image forming processing unit performs the different image forming processing by increasing cleaning frequency for a transfer device or a fixing device set in the image forming apparatus from cleaning frequency when a borderless-printing fixing device and a borderless-printing transfer device is set.

[A5] The image forming apparatus according to one of [A1] to [A4], further including:

a checking unit that checks whether software for performing borderless printing is installed if a borderless-printing fixing device and a borderless-printing transfer device are set in the image forming apparatus.

[A6] The image forming apparatus according to [A5], further including:

an installing unit that installs software for performing borderless printing via a communication line if the software is not installed.

[A7] A non-transitory computer readable medium storing a program causing a computer within an image forming apparatus to execute a process, the process including:

issuing a warning in the case of using a borderless printing function if a border-printing fixing device and a borderless-printing fixing device are replaceable by each other or a border-printing transfer device and a borderless-printing transfer device are replaceable by each other and if a fixing device set in the image forming apparatus is not a borderless-printing fixing device or if a transfer device set in the image forming apparatus is not a borderless-printing transfer device, wherein, if the warning is issued, the number of times of use for the borderless printing function or a user using the borderless printing function is restricted.

[A8] A non-transitory computer readable medium storing a program causing a computer within an image forming apparatus to execute a process, the process including:

performing image forming processing upon receiving an instruction to use a borderless printing function in a state in which a borderless-printing fixing device or a borderless-printing transfer device is not set in the image forming apparatus, the image forming processing being different from image forming processing performed when a borderless-printing fixing device and a borderless-printing transfer device are set in the image forming apparatus.

In the image forming apparatus according to [A1], it is possible to inform a user that a borderless-printing transfer device or a borderless-printing fixing device is not set. It is also possible to restrict the use of the borderless printing function according to the number of times of use for the borderless printing function or the user using the borderless printing function.

In the image forming apparatus according to [A2], it is possible to prevent a decrease in the image quality and a failure in the image forming apparatus which would be caused by borderless printing.

In the image forming apparatus according to [A3], it is possible to reduce the cleaning load.

In the image forming apparatus according to [A4], it is more likely that remaining toner in borderless printing will be properly cleaned.

In the image forming apparatus according to [A5], it is possible to check the installation of software for borderless printing when a borderless-printing fixing device and a borderless-printing transfer device are set in the image forming apparatus.

In the image forming apparatus according to [A6], it is possible to install software for borderless printing when a borderless-printing fixing device and a borderless-printing transfer device are set in the image forming apparatus.

In the non-transitory computer readable medium according to [A7], it is possible to inform a user that a borderless-printing transfer device or a borderless-printing fixing device is not set. It is also possible to restrict the use of the borderless printing function according to the number of times of use for the borderless printing function or the user using the borderless printing function.

In the non-transitory computer readable medium according to [A8], it is possible to prevent a decrease in the image quality and a failure in the image forming apparatus which would be caused by borderless printing.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

at least one processor; and at least one of a fixing device and a transfer device, wherein the fixing device comprises:

a border-printing fixing device; and a borderless-printing fixing device configured to be used interchangeably with the border-printing fixing device, wherein the transfer device comprises:

a border-printing transfer device; and a borderless-printing transfer device configured to be used interchangeably with the border-printing transfer device, wherein the at least one processor is configured to, if an instruction to execute a borderless printing function is received, and if the borderless-printing fixing device is not set, or the borderless-printing transfer device is not set, then restrict at least one of a number of times the borderless printing function may be executed and a user using the borderless printing function, and wherein the number of times is at least one.

2. A non-transitory computer readable medium storing a program that, when executed, causes a computer within an image forming apparatus to execute a process comprising:

restricting at least one of a number of times a borderless printing function may be executed and a user using the borderless printing function, if an instruction to execute the borderless printing function is received and at least one of:

a border-printing fixing device of the image forming apparatus and a borderless-printing fixing device of the image forming apparatus are configured to be used interchangeably and the borderless-printing fixing device is not set; and a border-printing transfer device of the image forming apparatus and a borderless-printing transfer device of the image forming apparatus are configured to be used interchangeably the borderless-printing transfer device is not set, wherein the number of times is at least one.

3. The image forming apparatus according to claim 1, wherein the image forming apparatus is configured to execute the borderless printing function without using the borderless-printing transfer device.

4. The image forming apparatus according to claim 3, wherein the image forming apparatus is configured to execute the borderless printing function without using the borderless-printing fixing device.

* * * * *